US005313765A

United States Patent [19]

Martin

[11] Patent Number: 5,313,765

[45] Date of Patent: May 24, 1994

[54] CAPPING MACHINE HEAD WITH MAGNETIC CLUTCH

[75] Inventor: Wendell S. Martin, Fort Smith, Ark.

[73] Assignee: Anderson-Martin Machine Company, Ft. Smith, Ark.

[21] Appl. No.: 787,011

[22] Filed: Nov. 4, 1991

[51] Int. Cl.[5] ..... B67B 3/20

[52] U.S. Cl. ..... 53/317; 53/331.5

[58] Field of Search ..... 53/306, 317, 331.5, 53/343; 192/56 R, 84 PM; 464/29, 30

[56] References Cited

U.S. PATENT DOCUMENTS

| | | | |
|---|---|---|---|
| 3,212,231 | 10/1965 | Pechman | 53/317 |
| 3,491,516 | 1/1970 | Bergeron | 53/317 |
| 3,955,341 | 5/1976 | Wilhere | 53/317 X |
| 3,974,884 | 8/1976 | Gidlund | 192/84 PM X |
| 4,115,040 | 9/1978 | Knorr | 192/84 PM X |
| 4,120,618 | 10/1978 | Klaus | 192/84 PM X |
| 4,364,218 | 12/1982 | Obrist | 53/331.5 |
| 4,485,609 | 12/1984 | Kowal | 53/331.5 |
| 4,535,583 | 8/1985 | Tanaka et al. | 192/84 PM X |
| 4,599,846 | 7/1986 | Ellis et al. | 53/331.5 |
| 4,633,646 | 1/1987 | Ellis et al. | 53/317 X |
| 4,674,264 | 6/1987 | Ellis et al. | 53/331.5 |
| 4,732,225 | 3/1988 | Jurgens et al. | 464/29 X |
| 4,808,869 | 2/1989 | Kopp | 192/84 PM X |

*Primary Examiner*—John Sipos

*Assistant Examiner*—Daniel Moon

*Attorney, Agent, or Firm*—Robert R. Keegan

[57] ABSTRACT

There is disclosed a capping machine head for affixing screw caps on containers, which in one embodiment has a cylindrical magnet ring in the body of the head surrounding a cap chuck driving element in a low friction bearing in the head, each having an array of permanent magnets distributed around their periphery. For certain angular relative positions of the ring and the chuck driving element, the North poles of one are face-to-face with the South poles of the other; displacement from such position causes torque on the order of ten to twenty inch pounds to be imparted to the chuck driving element. The chuck driving element rotates with the magnet ring until the resistance of a cap being threaded on the container exceeds a predetermined torque limit, after which the magnet ring rotates relative to the essentially stationary chuck driving element. The ring magnets may be in an axially misaligned position to reduce and control maximum torque value. Preferably the flux pattern of the magnets is elongated in an axial direction, by providing two rows of cylindrical magnets, or magnets which are elongated in that direction. The spring for urging the chuck downward is fully contained within the head. In some magnet arrangements torque is produced by both attraction and repulsion, and in others it is produced by attraction only.

11 Claims, 4 Drawing Sheets

CAPPING MACHINE HEAD WITH MAGNETIC CLUTCH

BACKGROUND OF THE INVENTION

The present invention relates to capping machines for affixing plastic screw closures on glass or plastic containers for beverages or the like. More particularly it relates to the head portions of a capping machine which serve to rotate the plastic screw cap with respect to the container while pressing on the cap and applying a limited predetermined tightening torque to the cap as controlled by an internal slip clutch. The capping machine head of the present invention is characterized by a magnetic clutch for torque control, preferably in the form of concentric cylindrical configurations of about twenty to forty magnets each with their North-South magnetization oriented radially.

1. Field of the Invention

The development of capping heads has been impelled in considerable part by the changes in closures which have progressed from the traditional crowns, to roll on aluminum caps, to plastic screw caps. With the advent of plastic screw caps, it became necessary to provide the capping machine heads with a slip clutch or other means so that the rotation of the upper part of the head with the spindle after the screw cap was tightly seated would not impart excessive torque causing the cap to be over-tightened or broken. At first such clutches were typically friction slip clutches, and in more recent years, magnetic clutches or magnetic drives have been employed to control the torque applied to the screw caps.

2. Description of the Related Art

Many variations on magnetic slip clutches are known, as shown for example in Swiss Patent to N. V. Philips' Gloelampenfabricken No. 313,871, or U.K. Patent to Owens Illinois No. 2,111,964A, I.C. B67B 3/20. U.S. Pat. No. 4,492,068 to Obrist issued Jan. 8, 1985, shows the use of a magnetic slip clutch in a screw closure capping machine head which takes the form of a pair of generally identical clutch plates, each having many cylindrical magnets embedded therein in a circular pattern near the periphery of the disk. The magnets are oriented North-South alternately around the periphery, and the two plates are attracted to preferred rotational alignments where each North pole of a magnet on one phase is aligned facing the South pole of a magnet on the other plate. Adjustment of the limiting torque in such a magnetic slip clutch may be achieved by varying the space between the plates and thus increasing or decreasing the attraction or repulsion of the aligned or nearly aligned magnets of the two plates.

Another magnetic torque control drive is shown for a screw closure capping head in U.S. Pat. No. 4,485,609 to Kowal, issued Dec. 4, 1984. This patent does not employ concentric arrays of magnets however, but rather employs one array of magnets in a cylindrical configuration which is intended to cooperate with a concentric ring of material with high magnetic permeability so that torque of a limited value is imparted to the cap chuck of the head.

SUMMARY OF THE INVENTION

The screw closure capper head according to the present invention has a different structure which provides significant advantages. The preferred embodiment employs concentric rings of magnets which are relatively rotatable and in which the North-South direction of the magnets are aligned radially. The magnets are arranged with alternate magnet North poles inward (the other magnets having their South poles inward). In one embodiment there are two tiers of magnets on each ring with twenty-four magnets in each tier of the outer ring while there are only half as many magnets in the inner ring (twelve in each tier). In the inner ring the two tiers are offset by 15°, and, to obtain proper magnet polarity, the upper tier is all North pole outward facing, and the lower tier is all South pole outward facing or vice-versa. Several other variations of the invention are disclosed which may provide certain advantages for particular purposes.

The apparatus of the invention provides a lower moment of inertia for the chuck rotating portion of the head, and also provides ample torque with adjustability to desired values with good reliability. In a magnetic slip clutch which operates in step-wise fashion as does the apparatus of the present invention, it is desirable to make the size of the step in degrees relatively low so that any problems with torque-reversal are eliminated or are negligible.

In addition to providing the features and advantages discussed above, it is an object of the present invention to provide a head for a machine for affixing plastic screw closures on containers wherein the coupling between the machine spindle and the screw cap chuck is provided entirely by magnetic force of an external ring of magnets secured relative to the spindle connector and arranged to produce magnet flux lines in a generally radial direction and a further internal ring of magnets rotationally fixed relative to the chuck driving means concentric with the first ring and also arranged to produce generally radial flux lines.

It is another object of the present invention to provide such a head for a capping machine wherein there are two tiers of magnets on the external ring and two tiers of magnets on the internal ring with there being only half as many magnets on the internal ring as the external ring.

It is still another object of the present invention to provide such a capping machine head wherein the magnets in both the internal ring and the external ring are peripherally arranged alternately North outward and North inward.

It is yet another object of the present invention to provide a head for a machine for affixing screw closures on containers having a circular member mounted to the spindle and having a circular member mounted to the chuck shaft, each having magnets mounted thereon with only a small space between the magnet poles on the respective members, and wherein each of the members has a North-South pair on the same angularly oriented radius.

BRIEF DESCRIPTION OF THE DRAWINGS

Other objects and advantages of the present invention will be apparent from consideration of the following description in conjunction with the appended drawings in which.

DESCRIPTION OF THE PREFERRED EMBODIMENTS

Figure 1:
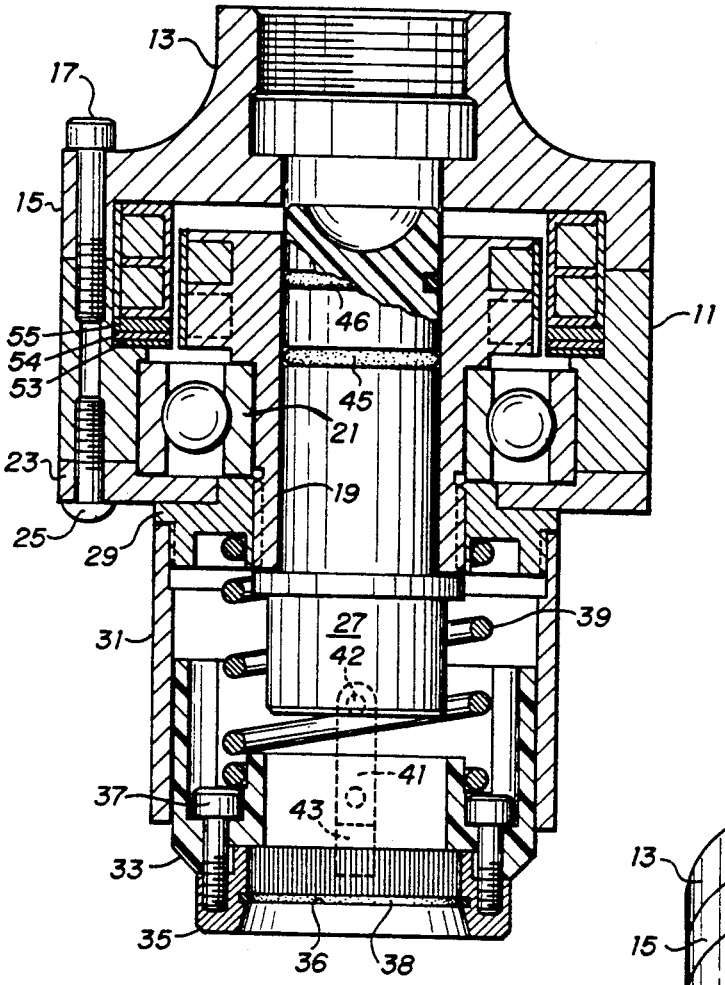
FIG. 1 is a vertical sectional view of a preferred embodiment of capping machine head with magnetic clutch.
Figure 2:
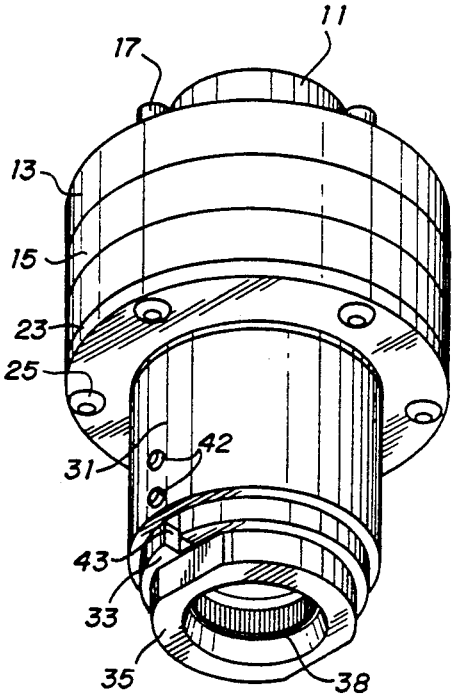
FIG. 2 is a perspective view thereof.
Figure 3:
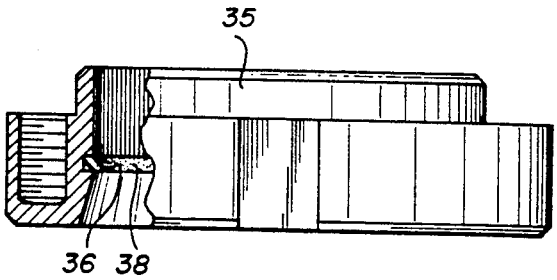
FIG. 3 is a fragmentary enlarged view of the cap engaging element of FIGS. 1 and 2.

Referring now to the drawings, and particularly FIGS. 1, 2, and 3, a head 11 for a capping machine is shown incorporating features of the present invention. The improved head 11 according to the invention is suitable for and intended for use on conventional plastic screw cap affixing machines such as those described in patents mentioned above or in commercial machines such as the Alcoa 200 Series. The heads described here may be employed with cap-in-head type machines in which the caps are fed to the chuck of the head, and thereafter fitted on the bottle or alternatively, with slight modification, on machines where the plastic cap is fed to and placed on top of the bottle mouth prior to the head descending and engaging the cap.

Head 11 includes a spindle connector 13 appropriately threaded to be secured on a capping machine spindle, and a body 15 removably secured to spindle 13 by suitable fasteners such as machine screws 17. A clutch element 19 is rotatably mounted in body 15 by means of a low friction bearing such as ball bearing 21, and secured by bearing nut 29.

A bearing retainer plate 23 secures the outer portion of bearing 21 in position in body 15 while bearing nut 29 secures the inner portion of bearing 21 relative to clutch element 19. Bearing nut 29 threadedly engages the lower portion of clutch element 19, and retainer plate 23 is secured on the body of 15 by suitable fasteners such as machine screws 25. Extending through the central opening in clutch element 19 is a cap ejector 27 which is operated in an appropriately timed sequence by an operating mechanism extending through the capping machine spindle. The cap ejection apparatus of the head is essentially conventional and forms no part of the present invention.

Bearing nut 29 is externally threaded to receive an internally threaded sleeve 31 which in turn receives cap chuck unit 33 in a telescoping fashion. Chuck unit 33 has secured thereon a demountable cap receivers 35 secured in place by machine screws 37. Various forms of cap receivers 35 can be secured on chuck unit 33 to accommodate a wide variety of caps while employing the same basic head mechanism otherwise. Cap receiver 35 includes an O-ring of elastomeric material 38 in an O-ring slot 36; O-ring 38 serves to capture and frictionally engage a cap received from a cap feeder mechanism while head 11 is descending on the container mouth. It is important to note that the central opening in the bottom of chuck unit 33 has a diameter less than the opening for receiving a cap in cap receiver 35 so that the received cap seats against the bottom of chuck unit 33 thereby assuring its proper orientation and avoiding any tilting or other misalignment as the cap is placed on a container.

Chuck unit 33 is free to slide up and down in sleeve 31 and is urged to a downward position with a desired predetermined force by coil spring 39. The spring constant for spring 39 may be from sixty to eighty pounds per inch and is generally not critical. However, the compression force may be changed as desired by the simple expedient of replacing spring 39 with a spring of the desired spring constant.

Rotational motion of chuck unit 33 relative to sleeve 31 is constrained by guide rails 41 secured on the interior of sleeve 31 by screws 42, the rails 41 being dimensioned to slide in slots 43 in chuck unit 33. O ring seals 45 and 46 are provided to protect the interior of the clutch mechanism from intrusion of liquids or other foreign material in accordance with conventional practice.

Referring now to FIGS. 4-7 in addition to FIGS. 1-3, a magnet ring 51 is mounted in body 15 and it is retained in place by spindle connector 13. Spacer rings 53, 54, and 55 occupy the space within body 15 and connector 13 so that magnet ring 51 is positioned and restrained vertically. As will be later explained in more detail, spacer rings 53, 54, 55, or any selected ones of them may be removed from on top of magnet ring 51 and placed below magnet ring 51, thereby shifting the vertical position of magnet ring 51 within body 15 to permit adjustment of the torque exerted by the magnetic clutch mechanism.

A magnet ring 18 resides within and concentric with magnet ring 51, and forms a part of clutch element 19. Ring 18 is shown integral with clutch element 19, but may be formed separately and affixed to clutch element 19 in any suitable fashion.

Figure 6:
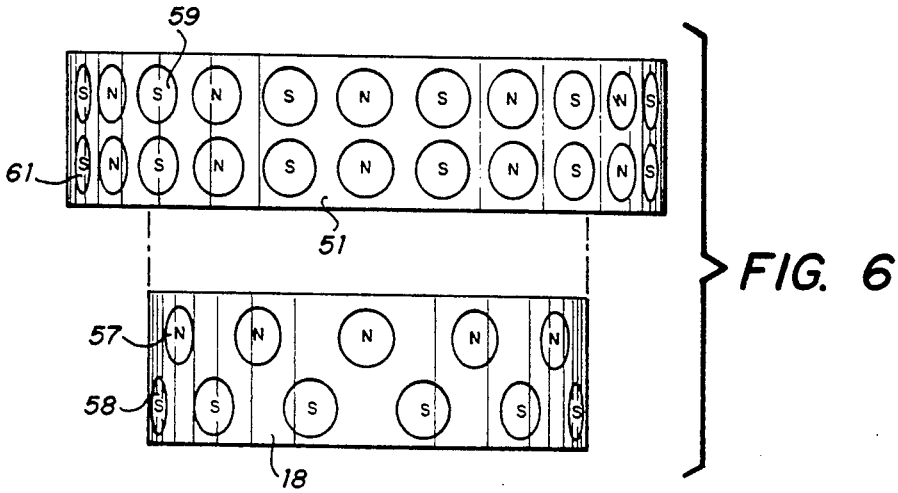
FIG. 6 is a schematic exploded view showing the relative positioning of the magnets in each of the rings of the apparatus of FIGS. 1-2.

Embedded in magnet ring 51 are a multiplicity of cylindrical bar magnets 59. Ring 51 is formed of non-magnetic metal or plastic and magnets 59 are peripherally North inward and South inward alternately. Magnet ring 18 is also formed of non-magnetic material, but in the case where ring 18 is separate from clutch element 19, the latter can be formed of magnetic material. Magnet ring 18 has two tiers of a multiplicity of magnets 57 and 58 embedded therein. As best seen in FIG. 6, the magnets of ring 51 comprise twenty-four magnets 59 and twenty-four magnets 61 in upper and lower tiers respectively. Magnet ring 18 has only 12 magnets in each of two tiers with magnets 58 of the lower tier being displaced by 15° from magnets 57 of the upper tier.

A retainer band 65 is provided for magnet ring 51 which may be of magnetically permeable material. Magnet ring 18 may be provided with a magnet retaining ring 63 of aluminum or other non-magnetic material.

Referring again to FIGS. 1-8 and particularly to FIGS. 4-8, it will be seen that magnets 57 and 58 of ring 18 may assume a position relative to magnets 59 and 61 of ring 51 wherein the magnetic South poles of ring 18 are aligned with magnetic North poles of ring 51 and vice-versa. This represents a neutral or idle position of the clutch where there is no torque exerted by the magnets tending to rotate one of the rings with respect to the other.

Figure 4:
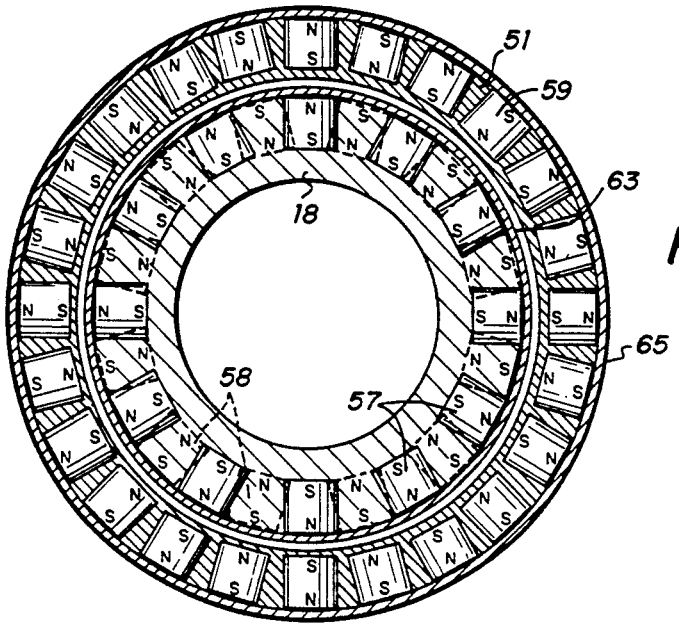
FIG. 4 is a partially schematic sectional view showing the arrangement of the magnet array in the apparatus of FIGS. 1 and 2.
Figure 5:
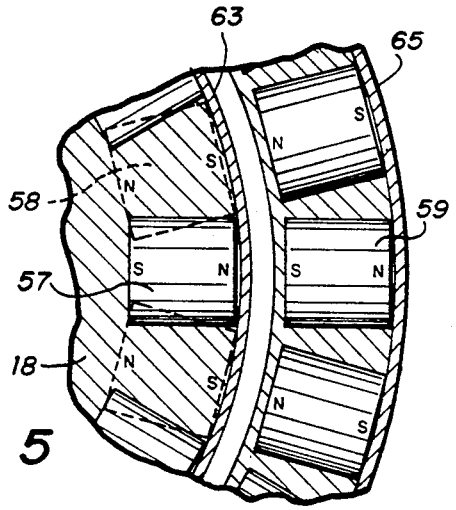
FIG. 5 is an enlarged fragmentary view of the magnet mounting arrangement from FIG. 4.

As either one of the rings is rotated relative to the other from the above described position as shown in FIG. 4, a torque is developed because the North-South facing magnetic poles tend to assume an aligned position, and also because an unbalanced repulsive force arises between a magnetic pole on one ring and the magnetic pole displaced by one position on the other ring. As one ring is rotated with respect to the other ring, this torque increases to a point and then decreases to zero when the magnets of the same polarity are exactly aligned and then reverses with a symmetrical effect as the magnetic poles again reach a position of alignment between opposite poles which is the neutral position. The distance between one neutral position and the next position is 30° in FIG. 4.

In operation, the clutch will only be slightly displaced from the neutral position when there is relatively little torque required to overcome the friction resistance of the screw cap on the container, and as that resistance becomes great the displacement between the two clutch rings will increase until the maximum torque is reached after which, the clutch will slip producing rapidly alternating torque impulses which have no net effect.

In practice there is also a torque produced by the deceleration of the rotating portion of the head as the chuck comes to a stop. It is desirable that this inertia effect be kept to a relatively low value since it is not readily subject to adjustment or control. The apparatus of the invention disclosed in FIGS. 1–8 provides relatively low inertia because the rotating ring associated with the chuck is the internal ring with a lesser radius than the external ring. This reduction in radius is important because the moment of inertia of an annulus is generally proportional to the fourth power of the radius.

It will be noted in FIG. 6 for example, that a preferred embodiment provides only half as many magnets on the inner ring 18 as are on the outer ring 51. This permits closer spacing of the magnets in the outer ring than is possible in the inner ring of lesser periphery. In the inner ring 18 the magnets are staggered in the top row of magnets 57 relative to the bottom row of magnets 58. As will later be discussed in more detail, the magnet arrangement of FIGS. 1–8 is a preferred example, but many different arrangements are possible which may provide advantages in certain respects.

Figure 7:
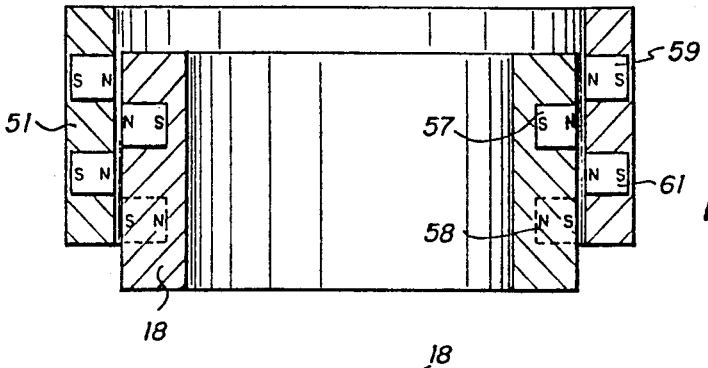
FIGS. 7 and 8 are schematic illustrations showing the function of the torque adjustment feature of the apparatus of FIGS. 1 and 2.
Figure 8:
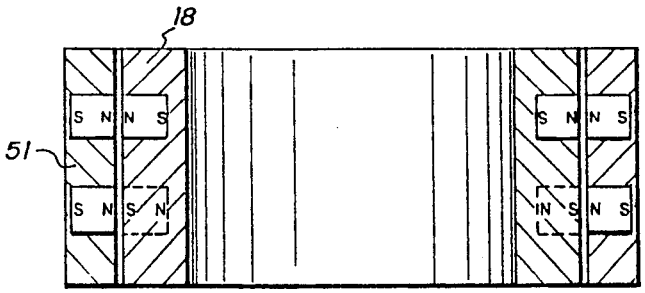

The adjustment of torque in the present apparatus is achieved by vertical displacement of ring 51 relative to ring 18 as shown in FIGS. 7 and 8. Maximum torque is achieved when the magnets are aligned as shown in FIG. 8 and by rearranging spacer rings 53, 54 and 55, the displacement of ring 51 can be adjusted in step-wise fashion to provide reduced torque down to approximately half the maximum torque of the aligned position of FIG. 8. Although ring 51 is displaced upward to create misalignment in the illustrated embodiment, obviously torque reduction could also be achieved by displacing ring 51 downward. Empirical observations indicate that the change in torque with displacement is roughly linear, thereby facilitating adjustment to desired values.

The three spacer rings in the illustrated embodiment are of one unit, two unit, and four units thickness, thereby giving eight possible displacements, and eight possible torques. By providing a greater number of spacer rings finer adjustment in torque values could be achieved if desired.

Figure 9:
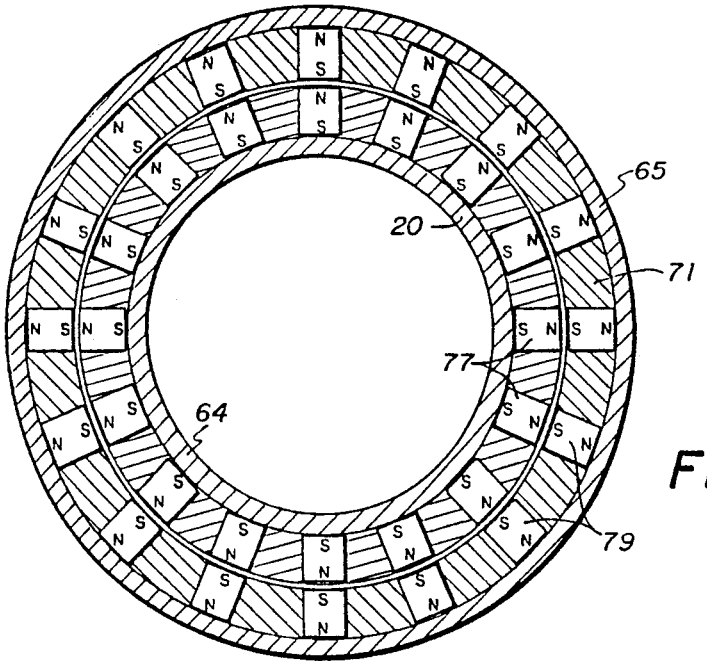
FIG. 9 is a plan view, partially schematic, showing an alternative magnet arrangement representing an alternative embodiment of the invention.
Figure 10:
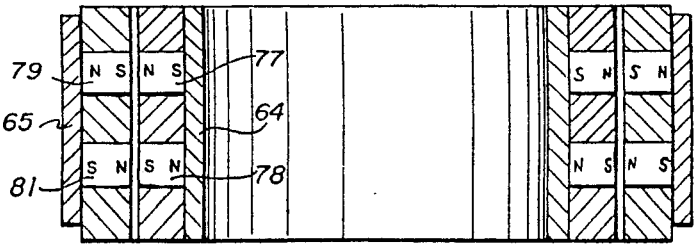
FIGS. 10 and 11 are schematic illustrations of the vertical cross section of the alternative embodiment of FIG. 9 showing the torque adjustment mode.
Figure 11:
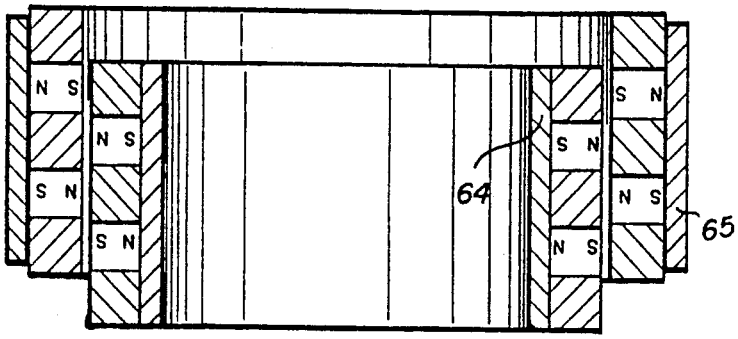

Referring now to FIGS. 9–11 an alternative embodiment of the invention is illustrated wherein the arrangement of the magnets in the magnet rings differs from that previously described.

Internal magnet ring 20 has sixteen magnets in each of two tiers and external magnet ring 71 has corresponding numbers of magnets 79 and 81. In magnet ring 20 all magnets 77 in the upper tier are arranged with the South pole facing outward, while all magnets 78 in the lower tier are arranged with the North pole facing outward.

In outer magnet ring 71 magnets 79 in the upper tier are all arranged with the North pole facing inward and magnets 81 in the lower tier are all arranged with magnetic South poles facing inward.

The function of the embodiment of FIGS. 9–11 accordingly differs in that there are no repulsive forces involved in the magnetic clutch operation. A neutral position exists for each alignment of the magnets, and thus, the neutral positions (and also the positions of maximum torque) are spaced apart by only one magnet position, or 22½°.

It may be noted that another variation of magnet arrangement could be employed wherein all magnets are arranged with the poles of the same polarity facing each other so that all forces were repulsive forces. A neutral position would then occur when the magnets of one ring were equidistant between adjacent magnets of the other ring.

The position of the magnet rings in FIG. 11 illustrates the adjustability feature for the embodiment of FIGS. 9–11 and it will be noted that the different polarizations for the upper tier of magnets and the lower tier of magnets causes more rapid diminution of torque with displacement of magnet ring 71 as magnets 81 assume a position where there is balanced attraction and repulsion from the magnets of ring 20.

In another variation of magnet arrangement, the magnets of the upper and lower tiers could be arranged with identical polarities in which case the adjustability feature would more nearly correspond to that shown in FIGS. 1–8.

In the embodiment of apparatus shown in FIGS. 9–11, and in fact in all embodiments of the apparatus, it may be found desirable to provide a flux path of high permeability for the magnets of each of the rings 20 and 71. Accordingly, ring 20 is provided with an internal annulus 64 of high magnetic permeability which may also serve in part to retain magnets 77 and 78 in place in ring 20. Since magnets 77 and 78 are oppositely oriented, the flux density at their poles is substantially increased by the lower magnetic permeability path provided by annulus 64.

In a similar fashion, an annulus 65 of material of high magnetic permeability provides a low reluctance flux path increasing the effectiveness of magnets 79 and 81. Although not specifically shown in all the other embodiments, it may be desired to provide high magnetic permeability material inside the inner rings and outside the outer rings of magnets for similar purposes in other embodiments.

Figure 12:
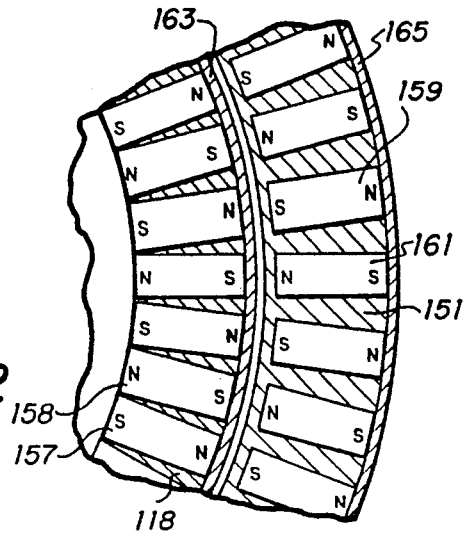
FIG. 12 is an enlarged fragmentary view of alternative forms of magnet arrays representing another alternative embodiment of the invention.
Figure 13:
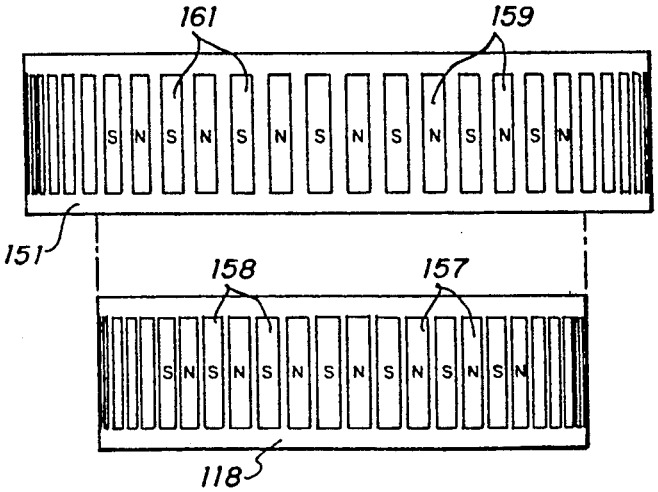
FIG. 13 is an exploded schematic illustration of the magnet rings of FIG. 12.

Referring now to FIGS. 12 and 13, an embodiment is shown which is a variation on the embodiment of FIGS. 1–8 wherein a pair of magnets in an upper tier and a lower tier is replaced by a single generally rectangular magnet with similar polarization. Thus an internal magnet ring 118 is provided with magnets with outwardly facing North poles 157 and other magnets with outwardly facing South poles 158, while an outer magnet ring 151 is provided with magnets with outwardly facing North poles 159 and magnets 161 with outwardly facing South poles 161.

Annulus 165 is provided for outer magnet ring 151 which may be of a material of high magnetic permeability. Inner magnet ring 118 may be provided with a magnet retaining ring 163.

The narrow configuration of magnets 157 and 158 permit the inner ring 118 to have the same number of magnets as the outer ring 151, which in the embodiment illustrated in FIG. 12 and 13 is fifty magnets in each ring. Although a lesser number of magnets could be used, there is some advantage in the larger number of magnets in that the rotation displacement between neutral torque positions is less and thus the interval during which reverse torque is applied is shorter, thereby reducing any possibility of kickback of the receiver which would loosen the cap.

As indicated in FIG. 13, outer magnet ring 151 is displaceable axially from inner ring 118 and as in the previous embodiments displacement from the aligned position of rings 151 and 118 reduces the interaction of the magnets and reduces the torque limit for the clutch.

Although a number of variations and modifications to the preferred embodiment of the invention have been shown described or suggested, other variations and modifications will be apparent to those skilled in the art, and accordingly, the scope of the invention is not to be considered limited to the embodiments shown or suggested, but is rather to be determined by reference to the appended claims.

What is claimed is:

1. A capper head incorporating a magnetic slip clutch comprising:

A. a body;

B. means for securing said body to a rotating capper machine spindle having an axis for rotation of said body;

C. a cylindrical chuck driving element rotatably mounted in said body with an axis of rotation coaxial with said capper machine spindle axis;

D. means for operatively connecting said body and said element and for reducing reverse torque induced rotation to avoid cap loosening, comprising:

i. a plurality of permanent magnets positioned on said element with their North-South polar axes oriented radially and with predetermined equal angular spacing not exceeding about 15 degrees between adjacent ones of said permanent magnets axes;

ii. a magnet ring surrounding said element rotationally fixed with respect to said body and having a plurality of permanent magnets therein with angular spacing therebetween equal to or a submultiple of said predetermined angular spacing; and iii. essentially all of said permanent magnets being of elongated rectangular cross-section transverse to their North-South polar axis, said elongated rectangular cross-section being at least about twice as long as wide, and said permanent magnets being arranged with the greatest elongated rectangular cross-section dimension parallel to the rotational axis of said chuck driving element.

2. Apparatus as recited in claim 1 wherein said permanent magnets in said magnet ring are arranged to have alternate North and South polarity around the periphery thereof.

3. Apparatus as recited in claim 1 further including a cap chuck affixed to said chuck driving element with limited freedom of axial movement relative thereto and means enclosed within said head for urging said chuck to a position most axially distant from said copper machine spindle.

4. Apparatus as recited in claim 1 further including means for positioning said magnet ring at one of a plurality of different axial positions relative to said check driving element.

5. A capper head incorporating a magnetic slip clutch comprising:

A. a body;

B. means for securing said body to a rotating capper machine spindle having an axis for rotation of said body;

C. a cylindrical chuck driving element rotatably mounted in said body with an axis of rotation coaxial with said capper machine spindle axis;

D. means for operatively connecting said body and said element and for reducing reverse torque induced rotation to avoid cap loosening, comprising:

i. a magnet ring surrounding said element rotationally fixed with respect to said body and having a set of at least twenty-four permanent magnets therein with their North-South polar axes oriented radially and predetermined equal angular spacing therebetween; and ii. a plurality of permanent magnets positioned on said element with their North-South polar axes oriented radially and with angular spacing therebetween equal to or a multiple of said predetermined equal angular spacing, said set of at least twenty-four permanent magnets having peripherally alternating North and South polarity.

6. Apparatus as recited in claim 5 further including a cap chuck affixed to said chuck driving element with limited freedom of axial movement relative thereto and means enclosed within said head for urging said chuck to a position most axially distant from said machine spindle.

7. Apparatus as recited in claim 5 further including means for vertically displacing said magnetic ring at one of a plurality of different axial positions relative to said chuck driving element.

8. A capper head incorporating a magnetic slip clutch comprising:

A. a body;

B. means for securing said body to a rotating capper machine spindle having an axis for rotation of said body;

C. a cylindrical chuck driving element rotatably mounted in said body with an axis of rotation coaxial with said capper machine spindle axis;

D. means for operatively connecting said body and said element and for reducing reverse torque induced rotation to avoid cap loosening, comprising:

i. a plurality of permanent magnets positioned on said element with their North-South polar axes oriented radially and with predetermined equal angular spacing not exceeding about 15 degrees between adjacent ones of said permanent magnets axes;

ii. a magnet ring surrounding said element rotationally fixed with respect to said body and having a plurality of permanent magnets therein with angular spacing therebetween equal to or a submultiple of said predetermined angular spacing; and iii. essentially all of said permanent magnets having cross-sectional configurations and orientation to provide a magnetic field of elongated, generally rectangular cross-section transverse to their North-South polar axis, said elongated, generally rectangular cross-section being at least about twice as long as wide, and said permanent magnets being arranged with the greatest elongated, generally rectangular cross-section dimension parallel to the rotational axis of said chuck driving element.

9. Apparatus as recited in claim 8 wherein said permanent magnets in said magnet ring are arranged to have alternate North and South polarity around the periphery thereof.

10. Apparatus as recited in claim 8 further including a cap chuck affixed to said chuck driving element with limited freedom of axial movement relative thereto and means enclosed within said head for urging said chuck to a position most axially distant from said capper machine spindle.

11. Apparatus as recited in claim 8 further including means for adjustably positioning said magnet ring at one of a plurality of different axial positions relative to said chuck driving element.

* * * * *